US005953860A

United States Patent [19]

Morgan et al.

[11] Patent Number: 5,953,860

[45] Date of Patent: Sep. 21, 1999

[54] DOUBLE HINGED SECURITY SYSTEM

[75] Inventors: Robert H. Morgan, Stamford, Conn.; Richard Armstrong, Mt. Jewett, Pa.

[73] Assignee: Kane Manufacturing Corporation, Kane, Pa.

[21] Appl. No.: 09/145,702

[22] Filed: Sep. 2, 1998

Related U.S. Application Data

[60] Provisional application No. 60/087,936, Jun. 4, 1998.

[51] Int. Cl.[6] ..... E05D 15/58

[52] U.S. Cl. ..... 49/257; 49/254

[58] Field of Search ..... 49/254, 255, 257, 49/258, 259, 50, 52, 61, 63, 67

[56] References Cited

U.S. PATENT DOCUMENTS

| | | | |
|---|---|---|---|
| 1,077,447 | 11/1913 | Yates . | |
| 2,558,789 | 7/1951 | Sillman . | |
| 2,698,677 | 1/1955 | Tadd | 49/259 |
| 3,485,406 | 12/1969 | Borden . | |
| 3,837,118 | 9/1974 | Goss, Jr. et al. . | |
| 3,852,915 | 12/1974 | Schacht . | |
| 4,059,923 | 11/1977 | Sauer . | |
| 4,193,225 | 3/1980 | Posner et al. . | |
| 4,384,428 | 5/1983 | Cox . | |
| 4,438,596 | 3/1984 | Jones et al. . | |
| 4,679,353 | 7/1987 | Langenbach et al. | 49/257 |
| 4,835,906 | 6/1989 | Collin . | |
| 4,993,187 | 2/1991 | Schweiss et al. . | |
| 5,056,262 | 10/1991 | Schweiss et al. . | |

FOREIGN PATENT DOCUMENTS

| | | | |
|---|---|---|---|
| B-24533/92 | 4/1993 | Australia . | |
| 1198650 | 12/1959 | France | 49/257 |
| 656162 | 8/1951 | United Kingdom | 49/257 |

*Primary Examiner*—Jerry Redman

*Attorney, Agent, or Firm*—St. Onge Steward Johnston & Reens LLC

[57] ABSTRACT

A security screen assembly installable in the jamb of a building window or door for preventing unauthorized access therethrough, while allowing for quick and easy egress, is provided. The security screen assembly includes a screen with a height, a width and side edges, and a frame which is dimensioned to fit within the jamb of a building, and which is attachable to the jamb. The frame defines an opening having a height substantially equal to the height of the screen and having a width which is less than the width of the screen. A channel is formed on a rear surface of the frame surrounding the opening. The channel accommodates the screen such that the channel prevents the screen from being swung inward. At least one double hinge is attached to the frame and to one of the side edges of the screen, such that the screen is slidable in the channel from a secured position, wherein the side edges of the screen are trapped behind the frame, to an unsecured position, wherein the side edge not attached to the hinge is not trapped behind said frame and the screen can be swung out at an angle relative to the frame to an open position. Preferably, the double hinge is a continuous double hinge extending along substantially the entire length of the side edge of the screen.

9 Claims, 4 Drawing Sheets

P
66
68
12
72
38
70
Q
82
88
10
84
64

74

DOUBLE HINGED SECURITY SYSTEM

REFERENCE TO COPENDING APPLICATION

This application claims priority from U.S. Provisional Application Ser. No. 60/087,936 filed Jun. 4, 1998.

FIELD OF THE INVENTION

The present invention relates to a security screen assembly, and more particularly to a security screen assembly installable in the jamb of a building window or door for preventing unauthorized access therethrough, while allowing for quick and easy egress.

BACKGROUND OF THE INVENTION

It is common practice to protect the windows of a building, especially those on the ground floor level, from unauthorized entry by means of window guards. Traditionally, such window guards have consisted of heavy gauge wire mesh screens or metal bars which are permanently attached to the building. A permanently installed window guard has a number of disadvantages, however, the primary disadvantage being that in the event of a fire or other emergency, it is not possible to leave the building through the guarded window. One must therefore find another means of escape, which means may not be available.

A number of prior art designs have been introduced to remedy the problems associated with permanent window guards. Each of these prior art designs, however, has its own disadvantages.

U.S. Pat. No. 4,835,906 to Collin discloses a security grill for preventing entrance through a door or window. The top end of the grill is inserted into a retention frame and the bottom end of the grill is pivoted downward and lowered into the frame. The grill is then locked into place using a deadbolt. A disadvantage of this prior art design is that the grill may be completely removed from the frame and, in fact, must be completely removed to exit therethrough. Such a removable grill may easily be lost or stolen, thus allowing for unauthorized access into the building until a new grill can be acquired. Another disadvantage is that the design does not allow for quick and easy egress through the window. Egress requires that the deadbolt be unlocked with a key, which during an emergency may not be readily available. Even if the key is available, the grill must be lifted within the frame and pivoted outward. However, since the metal grill must be resistant to unauthorized entry, it must be soundly constructed and is therefore likely to be heavy. Thus, a physically weak person, such as a child or elderly individual, may not be able to lift the grill enough to pivot it outward, and may therefore be trapped during an emergency.

U.S. Pat. No. 4,384,428 to Cox discloses a screen mounted on a frame by conventional hinges. Flanges on the frame prevent the screen from being pushed outward. To lock the screen in the closed position the end of a bar, which is slidably mounted in the screen, is slid into a corresponding notch in the frame. A disadvantage of this prior art design is that only the end of the bar engaging the frame prevents the screen from being opened. As such, the screen is susceptible to being forced inward by someone desiring unauthorized access to the building. Another disadvantage of this prior art design is that the screen may only be opened inward. In an emergency situation, when a number of people may be gathered around the window attempting to exit the building quickly, it may be easier to open the security screen outward.

U.S. Pat. Nos. 4,993,187 and 5,056,262 to Schweiss et al. disclose a releasable window guard assembly which includes a slideway socket in a frame for receiving a screen. The screen is hinged to the frame by hinge pins, which are attached to the frame and pass through elongated slots in the screen. In the security mode, the screen is trapped behind side plates of the frame. To open the window guard assembly the screen is slid horizontally within the slideway socket, the hinge pins sliding in the elongated slots, until the screen is no longer trapped behind the side plates. The screen is then in the access mode and may be swung outward. A disadvantage of this prior art design is that as the screen is opened, the force of gravity causes the screen to tilt downward. This is true because the hinge pins slide in the elongated slots in the screen as it is being swung outward, the upper hinge pin sliding to the outermost edge of the upper slot and the lower hinge pin sliding to the innermost edge of the lower slot. This tilting of the screen may cause the screen to bind with the bottom of the frame, thereby interfering with the opening of the screen. Moreover, once the screen is swung outward, the tilting of the screen may interfere with the screen from being closed, especially in the case of large, heavy screens.

What is desired, therefore, is a security screen assembly which is installable in the jamb of a building window or door for preventing unauthorized access therethrough, which allows for quick and easy egress from the building, which may be opened without a key, which is operable by a physically weak individual, which may be opened outwardly, which is resistant to forcible attempts to open from the outside, which may be easily opened from the inside, and which may be easily closed.

SUMMARY OF THE INVENTION

Accordingly, it is an object of the present invention to provide a security screen assembly which is installable in the jamb of a building window or door for preventing unauthorized access therethrough.

Another object of the present invention is to provide a security screen assembly having the above characteristics and which allows for quick and easy egress from the building.

A further object of the present invention is to provide a security screen assembly having the above characteristics and which may be opened without a key.

Still another object of the present invention is to provide a security screen assembly having the above characteristics and which is operable by a physically weak individual.

Yet a further object of the present invention is to provide a security screen assembly having the above characteristics and which may be opened outwardly.

Yet another object of the present invention is to provide a security screen assembly having the above characteristics and which is resistant to forcible attempts to open from the outside.

Still a further object of the present invention is to provide a security screen assembly having the above characteristics and which may be easily opened from the inside.

Yet another object of the present invention is to provide a security screen assembly having the above characteristics and which may be easily closed.

These and other objects of the present invention are achieved by provision of a security screen assembly having a screen with a height, a width, and side edges. Preferably, the screen comprises a perforated metal sheet disposed within a screen frame. The assembly also includes a frame which is dimensioned to fit within the jamb of a building, and which is attachable to the jamb. The frame defines an opening having a height substantially equal to the height of the screen and having a width which is less than the width of the screen. A channel is formed on a rear surface of the frame surrounding the opening. The channel accommodates the screen such that the channel prevents the screen from being swung inward. At least one double hinge is attached to the frame and to one of the side edges of the screen such that the screen is slidable in the channel from a secured position, wherein the side edges of the screen are trapped behind the frame, to an unsecured position, wherein the side edge not attached to the hinge is not trapped behind said frame and the screen can be swung out at an angle relative to the frame to an open position. Preferably, the double hinge is a continuous double hinge extending along substantially the entire length of the side edge of the screen.

The assembly preferably includes a spring attached to the frame within the channel which biases the screen toward the unsecured position. The screen is slidable against the bias to the secured position. The assembly also preferably includes a locking mechanism attached to the frame, such that the locking mechanism retains the screen in the secured position when the screen is slid within the channel to the secured position and also such that the locking mechanism is releasable to allow the screen to be slid within the channel to the unsecured position. Most preferably, when the locking mechanism is released, the spring causes the screen to slide within the channel to the unsecured position.

The invention and its particular features and advantages will become more apparent from the following detailed description considered with reference to the accompanying drawings.

DETAILED DESCRIPTION OF THE INVENTION

Figure 1:
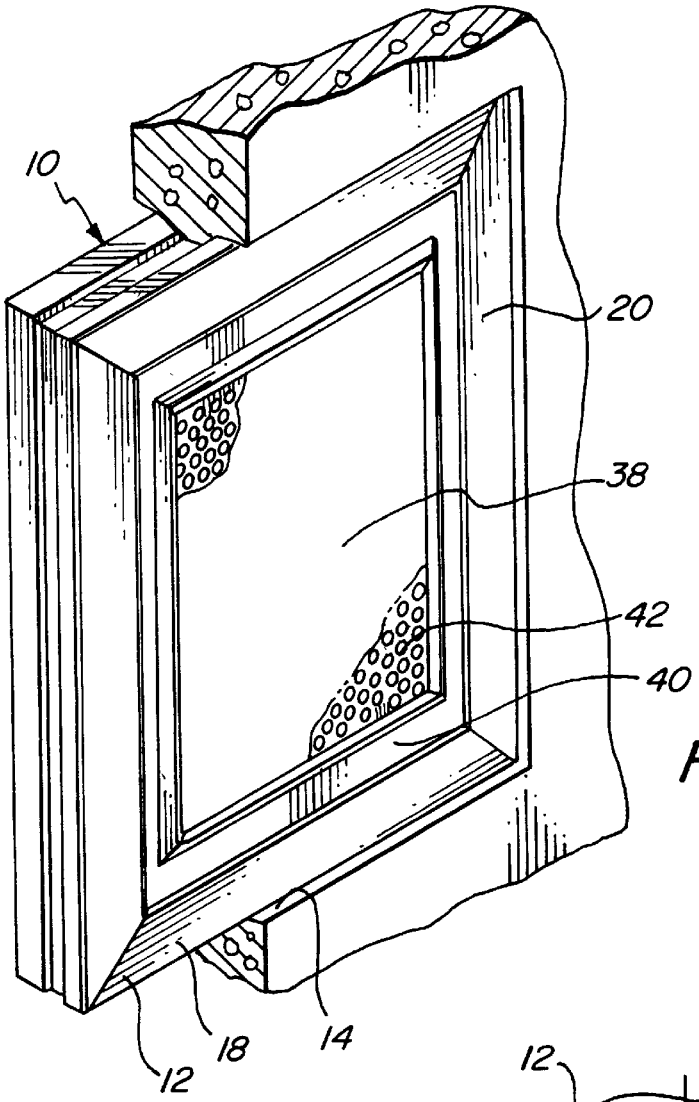
FIG. 1 is an isometric front view of a security screen assembly in accordance with the present invention shown installed in the jamb of a building and with a portion of the jamb cut away.
Figure 2:
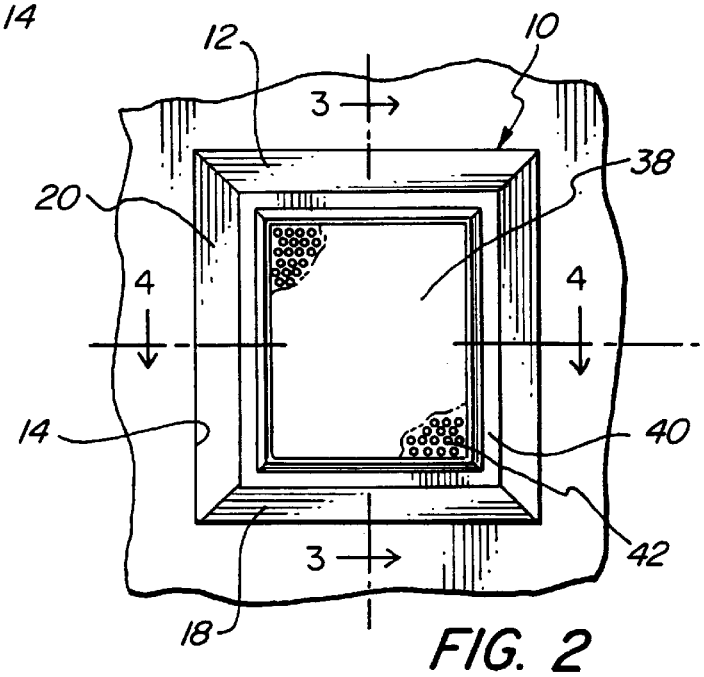
FIG. 2 is an plan front view of the security screen assembly of FIG. 1 shown installed in the jamb of a building.

Referring first to FIGS. 1 through 5, a security screen assembly 10 in accordance with the present invention is shown. Security screen assembly 10 includes a frame 12 which is sized and shaped to fit within the jamb 14 of a building window or door. Since jamb 14 will typically be rectangular in shape, frame 12 will also usually be rectangular. Frame 12 may be held in jamb 14 by anchors 16, or by any other suitable means.

In the preferred rectangular embodiment, frame 12 is comprised of horizontal legs 18 and vertical legs 20. Horizontal legs 18 each include an outer wall 22, which nests within jamb 14. Extending inward from the front edge of outer wall 22 is a front face 24. An inner wall 26 extends rearward from the inner edge of front face 24, and a rear wall 28 extends further inward from the rear edge inner wall 26. A rear face 30 extends inward from the rear edge of outer wall 22. Vertical legs 20 each include an outer wall 32, which nests within jamb 14. A front face 34 extends inward from the front edge of outer wall 32, and a rear face 36 extends inward from the rear edge of outer wall 32. Anchors 16 may pass through outer wall 22 of horizontal legs 18, through outer wall 32 of vertical legs 20, or through both. Horizontal legs 18 and vertical legs 20 are preferably integrally formed from a metal, most preferably aluminum, and their ends are preferably cut at forty-five degree angles such that the ends of horizontal legs 18 and vertical legs 20 may be mated and joined together, preferably by welding, to form a rectangular frame 12.

Security screen assembly 10 also includes a screen 38, which comprises a screen frame 40 and a screen element 42. Screen frame, which is preferably rectangular, 40 includes horizontal legs 44 and vertical legs 46. Horizontal legs 44 each include an outer wall 48, with a rear wall 50 extending inward from the rear edge of outer wall 48, and a front wall 52 extending inward from the front edge of outer wall 48. Vertical legs 46 each include an outer wall 54, with a front wall 56 extending inward from the front edge of outer wall 54. Front wall 52 of horizontal legs 44 and front wall 56 of vertical legs 46 may comprise flat plates or, as shown in FIGS. 1 through 5, may include a ridge or protrusion for aesthetic appeal. Horizontal legs 44 and vertical legs 46 include screen element retaining members 58, which receive screen element 42. Screen element 42 may be anchored therein by screws 60 or by any other suitable means. Horizontal legs 44 and vertical legs 46 are preferably integrally formed from a metal, most preferably aluminum, and their ends are preferably cut at forty-five degree angles such that the ends of horizontal legs 44 and vertical legs 46 may be mated and joined together, preferably by welding, to form a rectangular screen frame 40. Although numerous materials may be used to form screen element 42, such as heavy gauge wire mesh or a solid metal sheet, screen element 42 is preferably formed from a sheet of perforated metal to allow for visibility and ventilation therethrough, while providing a high level of security.

Referring again to frame 12, front faces 24 of horizontal legs 18 and front faces 34 of vertical legs 20 define an opening 62 having a height H substantially identical to the height of screen 38 and a width W which is smaller than the width of screen 38. Inner walls 26 and rear walls 28 of horizontal legs 18 and front faces 34 of vertical legs 20 define a channel 64 in which screen 38 is slidably disposed. Rear walls 28 prevent screen 38 from being pushed inward.

Screen 38 is attached to frame 12 via at least one double hinge 66. By double hinge, what is meant a hinge having a first attachment member 68 pivotally connected to an intermediate member 70, which in turn is pivotally connected to a second attachment member 72. Thus, double hinge 66 may be pivoted about two points P and Q, each pivot point being independent of the other. Double hinge 66 may be of virtually any length, and the number of hinges required will vary depending on the length of each double hinge 66 and the dimensions and weight of screen 38. However, it is preferable to use one continuous double hinge 66, of the type commonly referred to as a piano hinge, which extends along substantially the entire length of screen 38.

Figure 4:
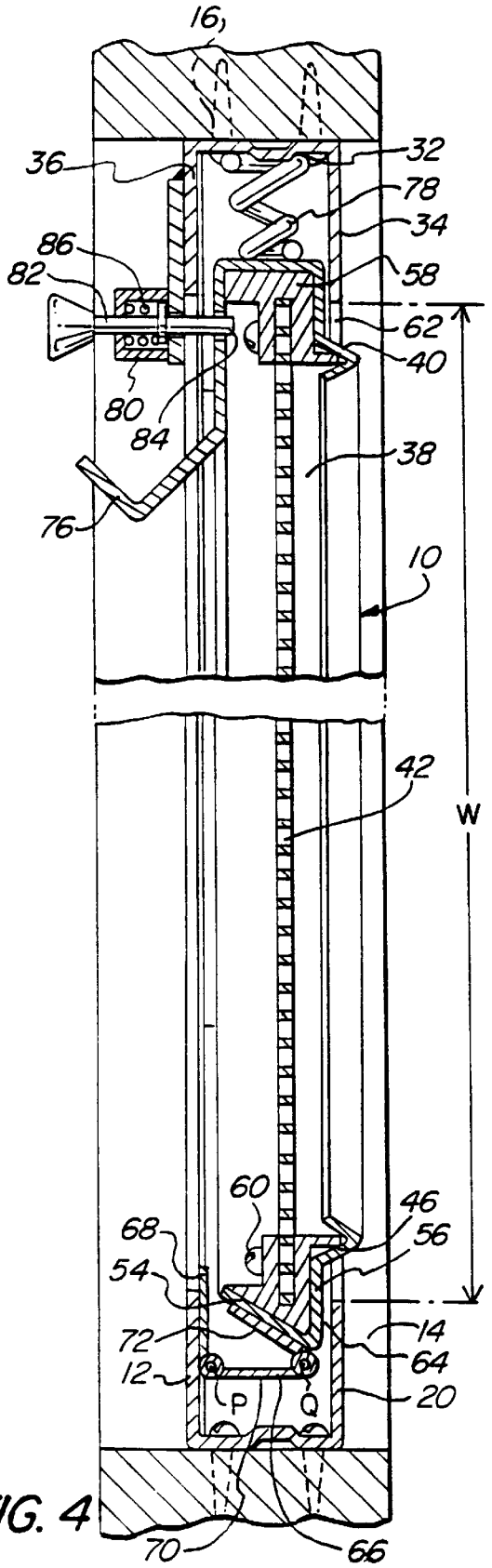
FIG. 4 is a partially cross-sectional top view of the security screen assembly taken along the plane 4—4 of FIG. 2.
Figure 5:
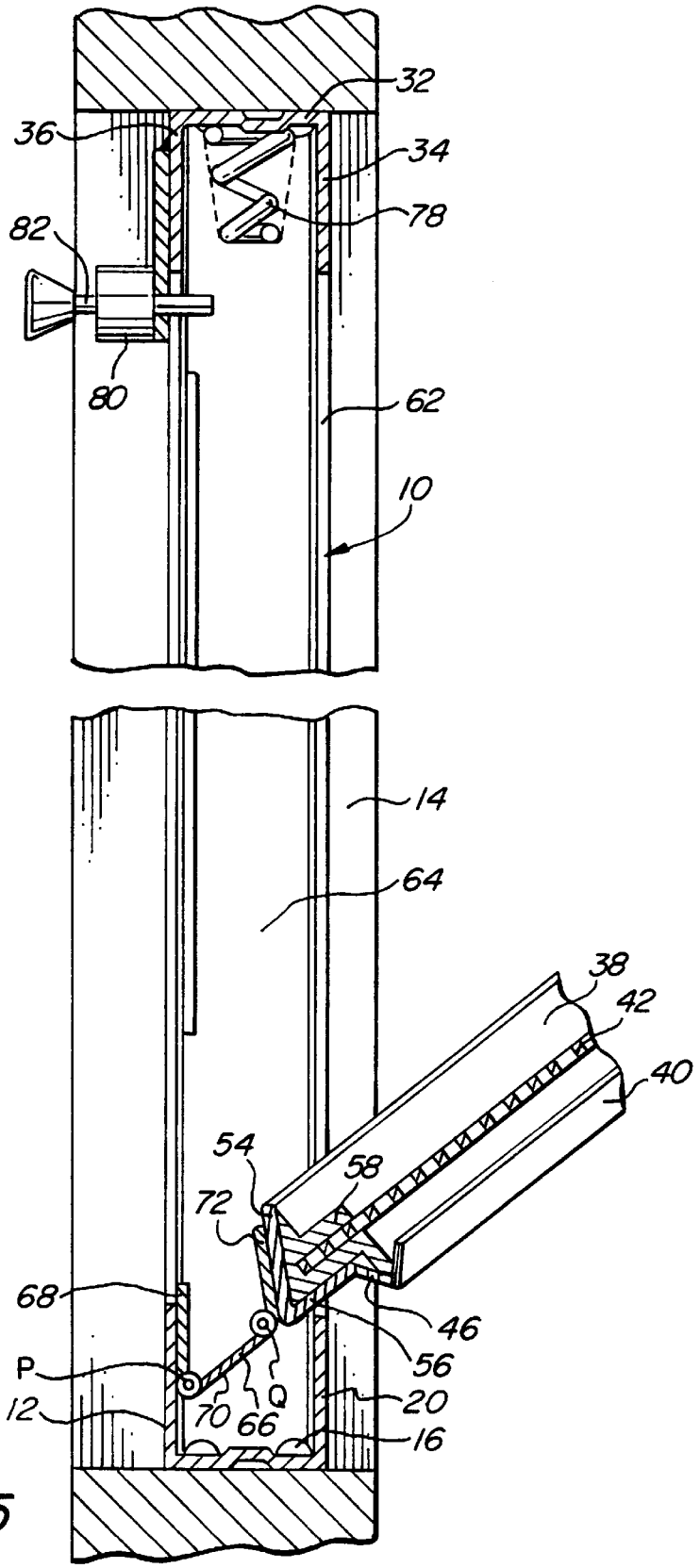
FIG. 5 is a partially cross-sectional top view of the security screen assembly similar to FIG. 4, but showing the screen partially open; and, FIGS. 6A–6E are schematic top views of the security screen assembly of FIG. 1 illustrating operation of the assembly as the screen is being opened.

First attachment member 68 of double hinge 66 is attached to rear face 36 of one of vertical legs 20 of frame 12, while second attachment member 72 of double hinge 66 is attached to outer wall 54 of one of vertical legs 46 of screen frame 40. Outer wall 54 of vertical leg 46 to which double hinge 66 is attached is bent inward, as is best seen in FIG. 4. This is done to provide a clearance between second attachment member 72 and intermediate member 70 of double hinge 66 so that as screen 38 is being opened, second attachment member 72 may pivot about pivot point Q towards intermediate member 70, as is discussed more fully below.

Figure 3:
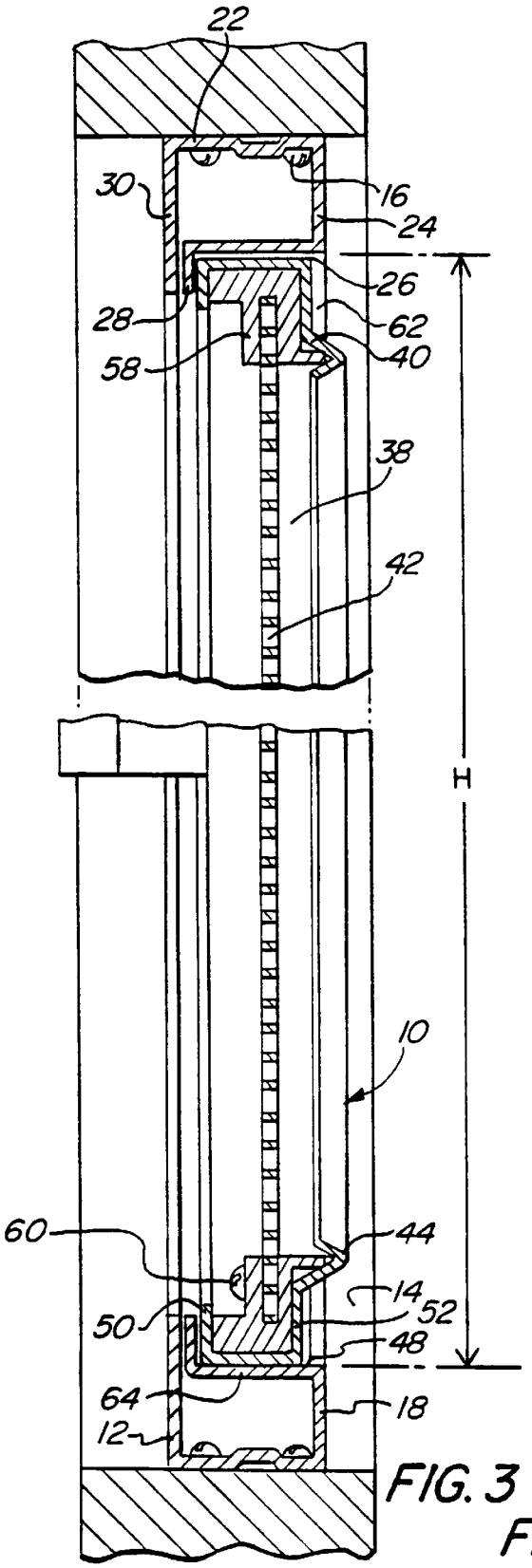
FIG. 3 is a partially cross-sectional side view of the security screen assembly taken along the plane 3—3 of FIG. 2.
Figures 6A, 6B, 6C, 6D, 6E:
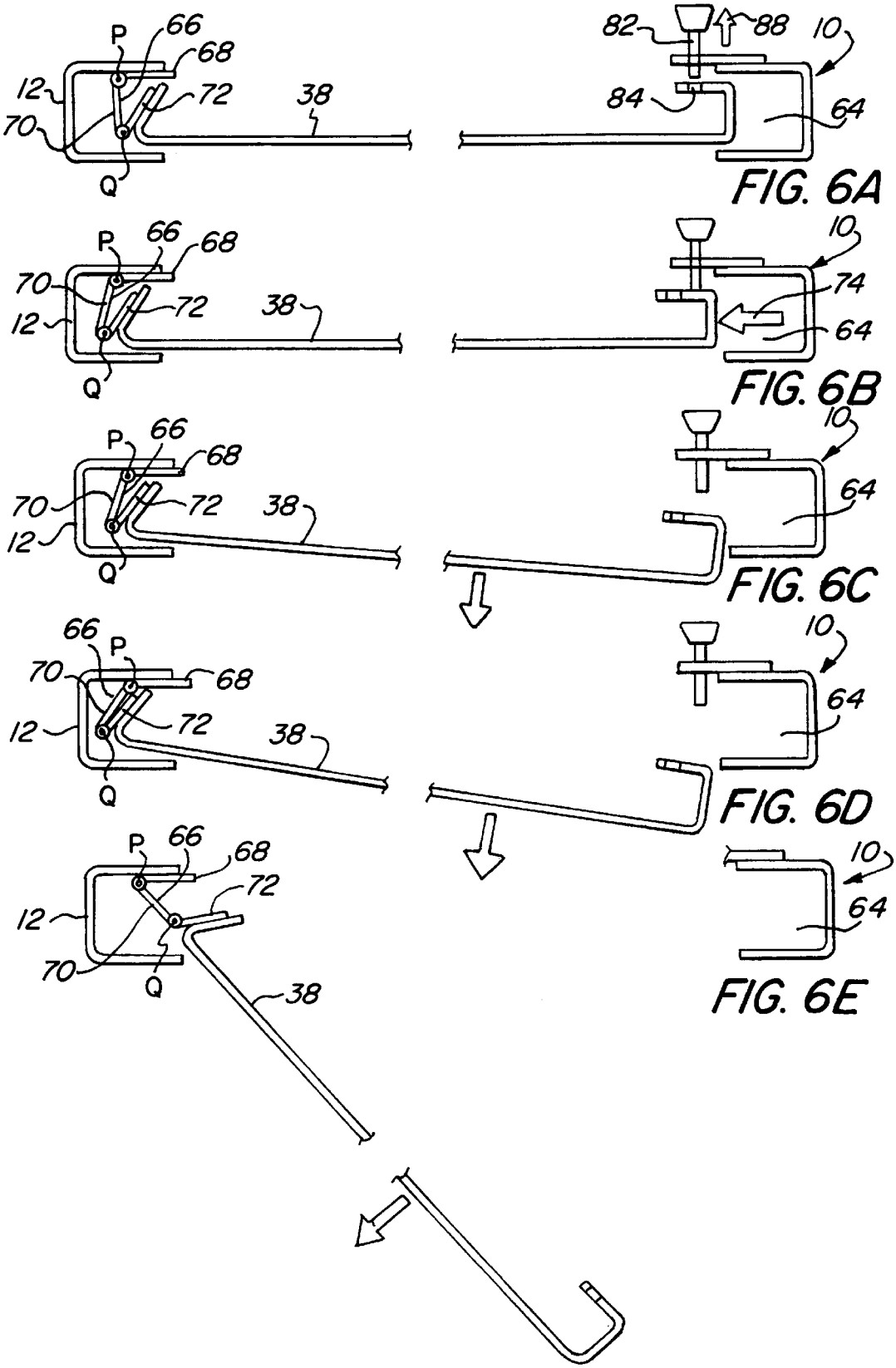

Operation of security screen assembly 10 will now be discussed. Referring now to FIGS. 3, 4 and 6A, screen 38 is in a secured position. Vertical legs 46 of screen frame 40 are both trapped behind front faces 34 of vertical legs 20 of frame 12. This is possible since the width W of opening 62 is smaller than the width of screen 38. As stated above, rear walls 28 prevent screen 38 from being pushed inward. Thus, screen 38 is trapped within frame 12.

Screen 38 is slid (illustrated by arrow 74) within channel 64 toward the side of screen 38 attached to double hinge 66 to the position shown in FIG. 6B. As screen 38 is slid within channel 64, intermediate member 70 pivots about pivot point P away from first attachment member 68, and second attachment member 72 pivots about pivot point Q toward intermediate member 70. This relative pivoting of second attachment member 72 toward intermediate member 70 is why outer wall 54 of vertical leg 46 to which double hinge 66 is attached is bent inward, as stated above. If such were not the case, attachment member 72 would not be able to be pivoted toward intermediate member 70. Once screen 38 is slid to the position shown in FIG. 6B, the vertical leg 46 of screen frame 40 not attached to double hinge 66 is no longer trapped behind front face 34 of vertical leg 20 of frame 12, and screen 38 is in an unsecured position.

FIGS. 6C through 6E show screen 38 being swung open relative to frame 12, which is possible since screen 38 is no longer trapped within frame 12. During the initial stages of opening screen 38 (shown in FIGS. 6C and 6D), intermediate member 70 pivots about pivot point P further away from first attachment member 68, and second attachment member 72 pivots about pivot point Q further toward intermediate member 70. Once a certain position is reached, however, intermediate member 70 begins to pivot about pivot point P toward first attachment member 68, and second attachment member 72 begins to pivot about pivot point Q away from intermediate member 70 (shown in FIG. 6E).

Additional features of the invention will now be discussed with reference to FIGS. 4 through 6E. Attached to the vertical leg 46 of screen frame 40 not attached to double hinge 66 is a handle 76, which is provided to facilitate the opening and closing of screen 38. Attached to outer wall 32 of the vertical leg 20 not attached to double hinge 66 is a spring 78 which contacts outer wall 54 of the vertical leg 46 not attached to double hinge 66 and biases screen 38 toward the unsecured position. Spring 78 acts in conjunction with a locking mechanism 80 to facilitate opening of screen 38, as discussed below.

Attached to rear face 36 of the vertical leg 20 not attached to double hinge 66 is releasable locking mechanism 80. Locking mechanism 80 acts to retain screen 38 in the secured position when screen 38 is slid within channel 64 to the secured position and is releasable from the inside to allow screen 38 to be slid within channel 64 to the unsecured position. Locking mechanism 80 may comprise a pin 82, which fits within a corresponding hole or channel 84 in handle 76 or screen frame 40 such that pin 82 may be inserted into hole or channel 84 when screen 38 is in the secured position. Preferably, pin 82 is biased by spring 86 toward screen 38 such that when screen 38 is slid from the unsecured position to the secured position, spring 86 causes pin 82 to engage hole or channel 84. To release locking mechanism 80, pin 82 may be pulled against the bias (illustrated by arrow 88 in FIG. 6A) of spring 86 until pin 82 no longer engages hole or channel 84. Screen 38, being biased toward the unsecured position by spring 78, slides to the unsecured position. As pin 82 is released, it is biased toward screen 38, thereby pushing screen 38 outward toward the open position.

The present invention, therefore, provides a security screen assembly which is installable in the jamb of a building window or door for preventing unauthorized access therethrough, which allows for quick and easy egress from the building, which may be opened without a key, which is operable by a physically weak individual, which may be opened outwardly, which is resistant to forcible attempts to open from the outside, which may be easily opened from the inside, and which may be easily closed.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A security screen assembly installable in a jamb of a building for preventing unauthorized access therethrough when in a secured position and for allowing egress from the building when in an open position, said security screen assembly comprising:

a screen having a height, a width, and side edges;

a frame dimensioned to fit within a jamb of a building and being attachable to the jamb, said frame defining an opening having a height substantially equal to the height of said screen and having a width which is less than the width of said screen;

a channel formed on a rear surface of said frame and surrounding the opening for accommodating said screen, wherein said channel prevents said screen from being swung inward; and at least one double hinge attached to said frame and to one of the side edges of said screen, whereby said screen is slidable in said channel from a secured position, wherein the side edges of said screen are trapped behind said frame, to an unsecured position, wherein the other of the side edges not attached to said hinge is not trapped behind said frame and said screen can be swung out at an angle relative to said frame to an open position.

2. The security screen assembly of claim 1 wherein said at least one double hinge comprises a continuous double hinge extending along substantially the entire length of the side edge of said screen.

3. The security screen assembly of claim 1 further comprising a spring attached to said frame within said channel biasing said screen toward the unsecured position and wherein said screen is slidable against a bias of said spring to the secured position.

4. The security screen assembly of claim 1 further comprising a locking mechanism attached to said frame, whereby said locking mechanism retains said screen in the secured position when said screen is slid within said channel to the secured position and whereby said locking mechanism is releasable to allow said screen to be slid within said channel to the unsecured position.

5. The security screen assembly of claim 4 wherein said locking mechanism is releasable without a key.

6. The security screen assembly of claim 4 further comprising a spring attached to said frame within said channel biasing said screen toward the unsecured position, and wherein when said locking mechanism is released, said spring causes said screen to slide within said channel to the unsecured position.

7. The security screen assembly of claim 1 wherein said screen comprises a screen frame with a perforated metal sheet disposed therein.

8. A security screen assembly installable in a jamb of a building for preventing unauthorized access therethrough when in a secured position and for allowing egress from the building when in an open position, said security screen assembly comprising:

a screen having a height, a width, and side edges, said screen comprising a screen frame with a perforated metal sheet disposed therein;

a frame dimensioned to fit within a jamb of a building and being attachable to the jamb, said frame defining an opening having a height substantially equal to the height of said screen and having a width which is less than the width of said screen;

a channel formed on a rear surface of said frame and surrounding the opening in said frame for accommodating said screen, wherein said channel prevents said screen from being swung inward;

a continuous double hinge attached to said frame and to one of the side edges of said screen, said hinge extending along substantially the entire length of the side edge of said screen, whereby said screen is slidable in said channel from a secured position, wherein the side edges of said screen are trapped behind said frame, to an unsecured position, wherein the other of the side edges not attached to said hinge is not trapped behind said frame and said screen can be swung out at an angle relative to said frame to an open position;

a locking mechanism attached to said frame, whereby said locking mechanism retains said screen in the secured position when said screen is slid within said channel to the secured position and whereby said locking mechanism is releasable to allow said screen to be slid within said channel to the unsecured position; and a spring attached to said frame within said channel biasing said screen toward the unsecured position, and wherein when said locking mechanism is released, said spring causes said screen to slide within said channel to the unsecured position.

9. The security screen assembly of claim 8 wherein said locking mechanism is releasable without a key.

* * * * *